US006729560B2

(12) United States Patent
Foster et al.

(10) Patent No.: US 6,729,560 B2
(45) **Date of Patent: *May 4, 2004**

(54) DUAL COMPONENT TRIGGER SPRAYER WHICH MIXES COMPONENTS IN DISCHARGE PASSAGE

(75) Inventors: Donald D. Foster, St. Charles, MO (US); Martin S. Laffey, O'Fallon, MO (US); John A. Zurcher, St. Charles, MO (US)

(73) Assignee: Continental Sprayers International, Inc., St. Peters, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/419,570

(22) Filed: Apr. 21, 2003

(65) Prior Publication Data

US 2003/0201339 A1 Oct. 30, 2003

Related U.S. Application Data

(63) Continuation of application No. 08/349,741, filed on Dec. 5, 1994, now Pat. No. 6,550,694.

(51) Int. Cl.[7] ..... A62C 13/62; A62C 13/66; A62C 31/00; B67D 5/52; B67D 5/40

(52) U.S. Cl. ..... 239/304; 239/333; 239/398; 239/472; 222/137; 222/255; 222/383.1

(58) Field of Search ..... 239/304, 333, 239/398, 472, 419; 222/137, 255, 383.1, 135, 145.5

(56) References Cited

U.S. PATENT DOCUMENTS

| | | | | | |
|---|---|---|---|---|---|
| 3,760,986 | A | * | 9/1973 | Castner et al. | 222/137 |
| 3,966,089 | A | | 6/1976 | Klingaman | |
| 4,204,614 | A | | 5/1980 | Reeve | |
| 4,257,561 | A | | 3/1981 | McKinney | |
| 4,346,821 | A | | 8/1982 | Wesner et al. | |
| 4,355,739 | A | * | 10/1982 | Vierkotter | 222/134 |
| 4,516,695 | A | | 5/1985 | Garneau | |
| 4,765,510 | A | | 8/1988 | Rende | |
| 4,826,048 | A | * | 5/1989 | Skorka et al. | 222/137 |
| 4,902,281 | A | | 2/1990 | Avoy | |
| 4,958,754 | A | * | 9/1990 | Dennis | 222/383.1 |
| 4,971,227 | A | | 11/1990 | Knickerbocker et al. | |
| 5,009,342 | A | * | 4/1991 | Lawrence et al. | 222/136 |
| 5,040,701 | A | | 8/1991 | Knickerbocker et al. | |
| 5,040,702 | A | | 8/1991 | Knickerbocker et al. | |
| 5,050,779 | A | | 9/1991 | Knickerbocker | |
| 5,152,431 | A | | 10/1992 | Gardner et al. | |
| 5,152,461 | A | * | 10/1992 | Proctor | 239/304 |
| 5,161,716 | A | | 11/1992 | Knickerbocker | |
| 5,169,029 | A | * | 12/1992 | Behar et al. | 222/1 |
| 5,169,032 | A | | 12/1992 | Steijns et al. | |
| D336,846 | S | * | 6/1993 | Proctor | D9/300 |
| 5,228,600 | A | | 7/1993 | Steijns et al. | |
| 5,238,152 | A | | 8/1993 | Maas et al. | |
| 5,297,701 | A | | 3/1994 | Steijns et al. | |
| 5,332,157 | A | * | 7/1994 | Proctor | 239/304 |
| 5,339,990 | A | * | 8/1994 | Wilder | 222/135 |
| 5,398,846 | A | * | 3/1995 | Corba et al. | 222/1 |
| 5,402,916 | A | * | 4/1995 | Nottingham et al. | 222/134 |
| 5,439,141 | A | * | 8/1995 | Clark et al. | 222/136 |
| 5,472,119 | A | * | 12/1995 | Park et al. | 222/145.8 |
| 5,477,989 | A | | 12/1995 | Maas et al. | |
| 5,482,186 | A | | 1/1996 | Rodden, Jr. | |
| 5,560,545 | A | * | 10/1996 | Grogan et al. | 239/304 |

FOREIGN PATENT DOCUMENTS

| | | |
|---|---|---|
| EP | 598237 | 5/1994 |

* cited by examiner

*Primary Examiner*—Michael Mar
*Assistant Examiner*—Darren Gorman
(74) *Attorney, Agent, or Firm*—Thompson Coburn LLP

(57) ABSTRACT

The present invention pertains to a trigger sprayer which is connectable to two container volumes containing separate liquids. The sprayer has a trigger that is manipulated to draw the separate liquids into two separate pump chambers and then supply the two separate liquids from the pump chambers to a discharge passage of the sprayer. In the discharge passage the two separate liquids are mixed together prior to their being dispensed from the discharge passage as a spray.

35 Claims, 4 Drawing Sheets

DUAL COMPONENT TRIGGER SPRAYER WHICH MIXES COMPONENTS IN DISCHARGE PASSAGE

This patent application is a continuation of patent application Ser. No. 08/349,741, filed Dec. 5, 1994, which issued as U.S. Pat. No. 6,550,694 B1 on Apr. 22, 2003.

BACKGROUND OF THE INVENTION (1) Field of the Invention

The present invention pertains to a trigger sprayer which is connectable to two container volumes containing separate liquids. The sprayer has a trigger that is manipulated to draw the separate liquids into two separate pump chambers and then supply the two separate liquids from the pump chambers to a discharge passage of the sprayer. In the discharge passage the two separate liquids are mixed together prior to their being dispensed from the discharge passage as a spray.

(2) Description of the Related Art

Trigger sprayers are those types of sprayers having pivoting triggers that are manually manipulated to dispense liquids from the sprayers. A typical trigger sprayer is connected to a liquid container for dispensing the contents of the container as a spray, stream, or foam in response to manual reciprocation of the trigger. This type of trigger sprayer has been employed in the past in dispensing various different types of liquids from containers to which the trigger sprayers have been attached. However, the conventional trigger sprayer has drawbacks when employed with certain types of liquids.

Certain liquids dispensed from conventional trigger sprayers are the product of two or more separate component liquids that remain stable while separated but have a limited shelf life when they are mixed together. Trigger sprayers attached to containers containing liquids of this type cannot remain in storage or on a store shelf for a prolonged period of time before the liquid product begins to lose its effectiveness. To employ conventional trigger sprayers for dispensing liquids of this type and to ensure that the shelf life of the liquid product does not expire before the product is sold, the separate liquid components of the final liquid product must be mixed together to produce the final liquid product just prior to the liquid product being packaged in the containers and shipped to the market where they are offered for sale.

In addition, some liquid products are comprised of one or more component liquids that do not readily mix with each other, for example, water and oil. When liquid products of this type are packaged in containers with trigger sprayers, the separate liquid components that make up the final product tend to separate from each other while the product is stored in inventory or while the product sits on a store shelf awaiting sale. In use of a conventional sprayer containing a product of this type, after the component liquids of the final product had separated out, operation of the trigger sprayer would result in dispensing only that liquid component that had settled to the bottom of the container. In the oil and water example, only the water component of the liquid would be dispensed initially from the sprayer. Once all of the water had been dispensed, then only oil would be dispensed from the sprayer.

Various multiple-compartment trigger sprayers have been designed to overcome the problems associated with the conventional trigger sprayer employed in dispensing liquid products having limited shelf life and/or components that tend to separate from each other over time. These new designs include trigger sprayers that are attached to liquid containers that keep the component parts of a liquid product separate from each other until they are drawn from the containers by the trigger sprayers. Trigger sprayers of this type include sprayers that mix the separate component parts of a liquid product for the first time in the pump chambers of the sprayers prior to their being dispensed. However, even these newer designs of trigger sprayers have drawbacks. Once the trigger sprayer pump chamber is primed with the two components of the final liquid product, as the trigger sprayer sits between uses the shelf life of the liquid product in the pump chamber could expire. Also, the separate liquid components of the final product could separate from each other in the sprayer pump chamber. As a result, the next time the trigger sprayer is operated, the liquid first dispensed from the sprayer would be that contained in the pump chamber. This liquid could have an expired shelf life or separated component liquids. In either situation, the quality of the liquid first dispensed from the sprayer would be less than that expected.

It is an object of the present invention to overcome the disadvantages associated with prior art trigger sprayers employed in dispensing liquids comprised of at least two separate component liquids. The trigger sprayer of the present invention keeps the two component liquids separate from each other until they are mixed together for the first time in the discharge passage of the sprayer just prior to their being dispensed from the sprayer. Thus, the problems of expired shelf life and/or separation of component liquids in the container or trigger sprayer are avoided.

SUMMARY OF THE INVENTION

The trigger sprayer of the present invention is designed to be attached to a container containing two separate liquid components. The two liquid components are mixed together into a final liquid product by the sprayer just prior to their being dispensed from the sprayer. The sprayer of the invention may be connected to two separate containers containing the two separate liquid components, or alternatively may be connected to a single liquid container having a partition in its interior dividing the container into two separate container volumes containing the separate liquid components.

The trigger sprayer of the invention includes a sprayer housing that is basically comprised of two separate sections, a pump chamber section and a vent chamber section. These two sections are molded separate from each other for manufacturing economy, and then are assembled together to form the housing of the trigger sprayer.

Contained within the housing is a fluid discharge passage. A nozzle assembly having a liquid discharge orifice is inserted into one end of the discharge passage and an inlet opening is provided adjacent an end wall at the opposite end of the discharge passage. A fluid spinner is contained in the discharge passage adjacent the discharge orifice and a one-way valve is contained in the discharge passage adjacent the inlet opening.

A pair of separate pump chambers are provided in the pump chamber section of the housing. Each chamber has a piston mounted for reciprocating movement therein. Each of the pump pistons is connected to a single trigger mounted to the sprayer housing for pivoting movement of the trigger relative to the housing. The pump pistons are reciprocated in their respective pump chambers in response to pivoting movement of the trigger.

A pair of separate vent chambers are provided in the vent chamber section of the sprayer housing. Each vent chamber of the pair communicates with one of the two separate container volumes through a vent passageway that extends between the vent chamber and its associated container volume. A pair of vent pistons are contained in the vent chambers for reciprocating movement of the pistons therein. The reciprocating movement of the vent pistons in the vent chambers opens and closes communication between an exterior environment of the sprayer housing and the two separate container volumes through the pair of vent passageways and the pair of vent chambers. Each of the vent pistons is operatively connected to the trigger and reciprocates in its associated vent chamber in response to pivoting movement of the trigger on the sprayer housing.

A pair of separate liquid passageways extends through the sprayer housing. The pair of passageways communicate the pair of pump chambers with the inlet opening of the fluid discharge passage through a pair of exit openings in the end wall of the discharge passage. The pair of liquid passageways also communicate the two pump chambers with the two separate container volumes. Each of the liquid passageways has a check valve therein. The check valves of the two liquid passageways permit the two separate liquids contained in the two separate container volumes to be drawn through the passageways to the pair of pump chambers in response to reciprocating movement of the pump pistons within their respective chambers. The check valves prevent the reverse flow of liquid from the pump chambers back through the passageways to the two separate container volumes. The two separate liquids drawn into the two separate pump chambers are pumped from the two pump chambers through the liquid passageways and the pair of exit openings into the inlet opening of the discharge passage where the two separate liquids are mixed together for the first time. The flow of the two liquids through the two exit openings into the discharge passage inlet is controlled by the one-way valve in the discharge passage. The one-way valve permits the flow of the two separate liquids through the exit openings to the inlet opening, but prevents the reverse flow of liquid from the inlet opening through the pair of exit openings. The two separate liquids mixed together in the discharge passage form the final liquid product that is pumped through the fluid spinner in the discharge passage and is dispensed from the trigger sprayer through the nozzle orifice.

DESCRIPTION OF THE DRAWING FIGURES

Further objects and features of the present invention are revealed in the following description of the preferred embodiment of the invention and in the drawing figures wherein.

DESCRIPTION OF THE PREFERRED EMBODIMENT

Figure 1:
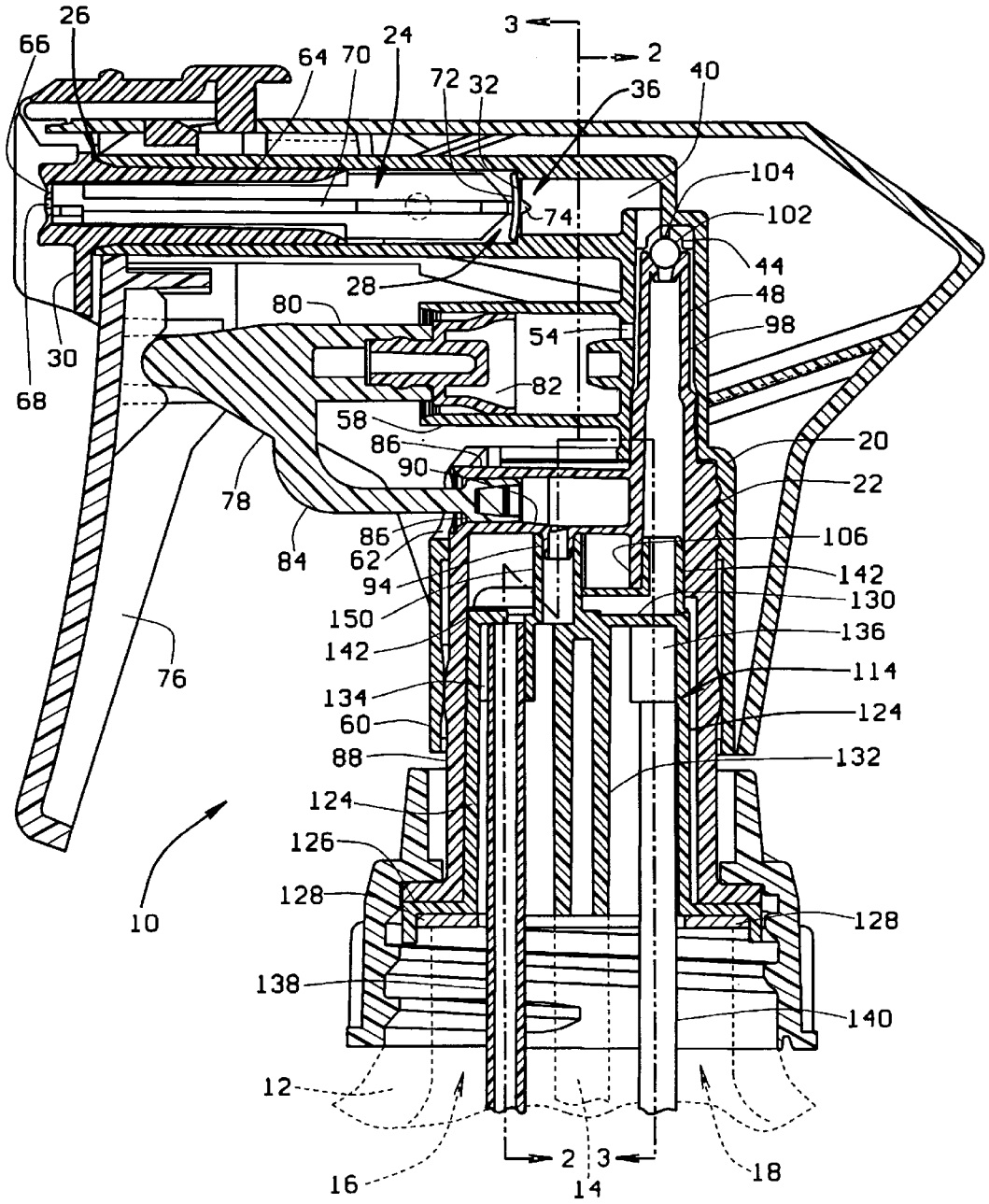
FIG. 1 is a side elevation view in section of a trigger sprayer of the present invention.

The trigger sprayer of the present invention is designed to be attached to a container containing two separate liquid components in separate interior volumes of the container. The two liquid components kept separate in the container are mixed together into the final liquid product by the sprayer just prior to their being dispensed from the sprayer. The sprayer of the invention may be connected to two separate containers containing the two separate liquid components in their separate volumes, or alternatively may be connected to a single liquid container having a partition in its interior dividing the container into two separate volumes containing the separate liquid components. The trigger sprayer 10 of the invention is shown in FIG. 1 connected to a single container 12 having an interior partition 14 separating-the container interior into separate container volumes 16, 18. The container shown in dashed lines in FIG. 1 is employed for illustrative purposes only and the trigger sprayer 10 of the present invention should not be interpreted as only being adapted for use with this one particular type of container.

The trigger sprayer 10 of the invention includes a sprayer housing that is basically comprised of two separate housing sections, a pump chamber section 20 and a vent chamber section 22. Both housing sections are constructed of plastic as is typical. The two housing sections are assembled to each other and the remaining component parts of the trigger sprayer are assembled into these two housing sections as will be explained.

Figure 4:
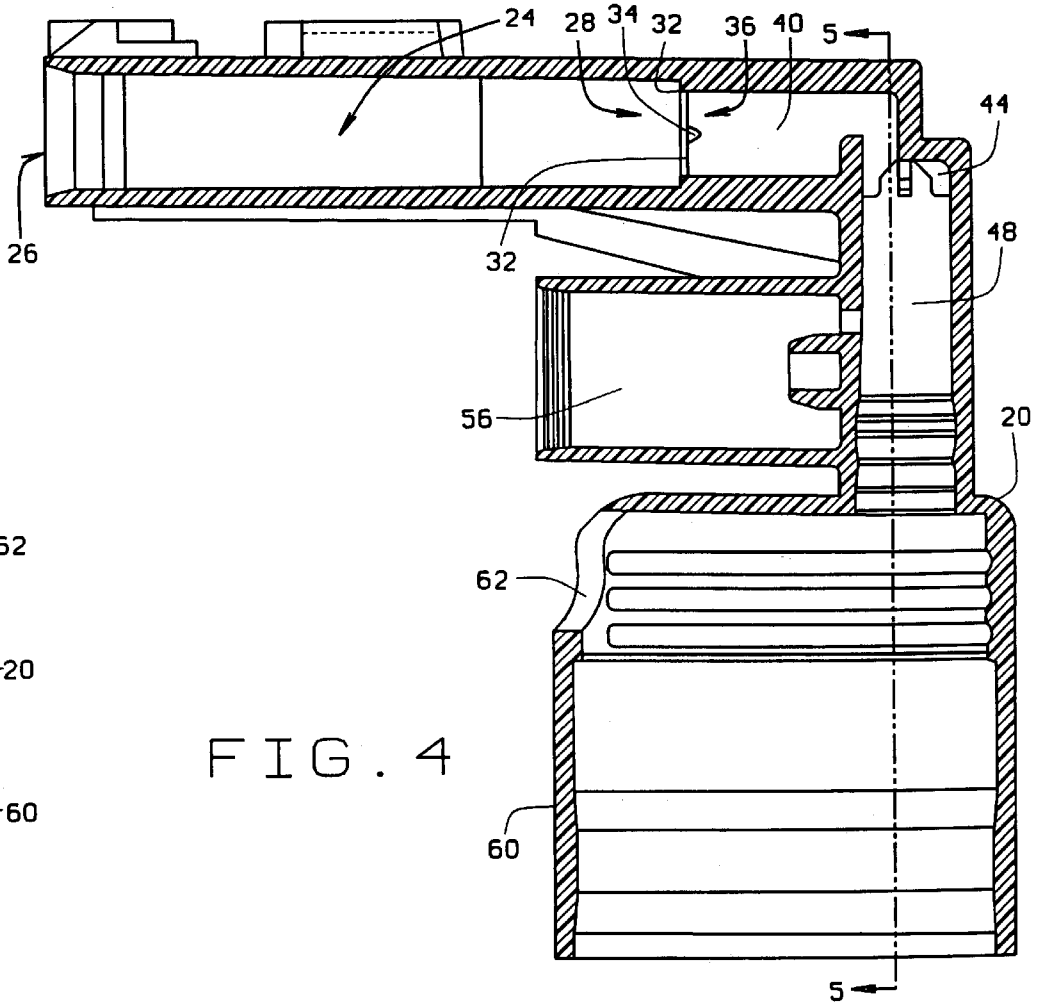
FIG. 4 is a side elevation view in section of the pump chamber section of the sprayer housing.
Figure 5:
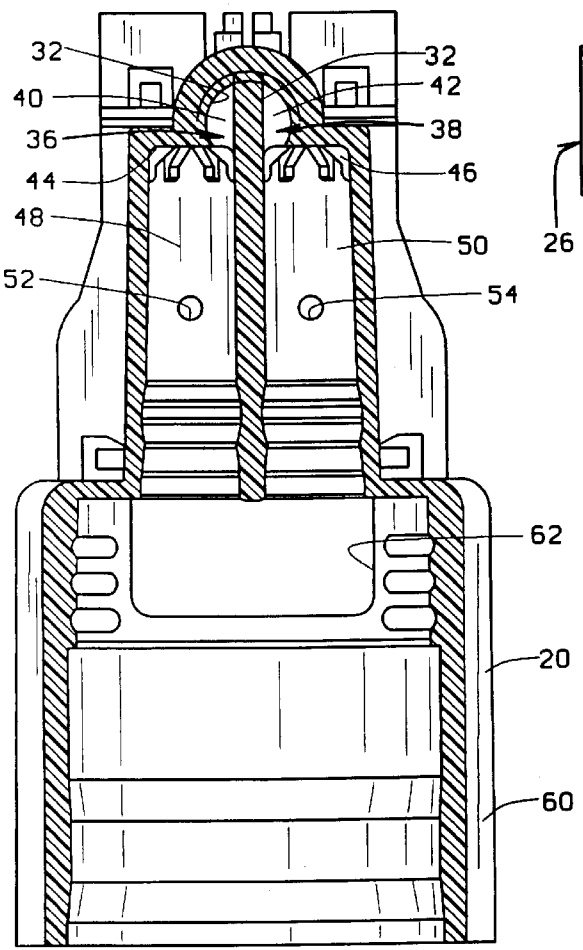
FIG. 5 is a rear elevation view in section of the pump chamber section of the sprayer housing taken along the line 5—5 of FIG. 4.

Referring to FIGS. 4 and 5, the pump housing section 20 is shown disassembled from the vent chamber section and the other component parts of the trigger sprayer. The pump chamber section 20 includes a fluid discharge passage 24 that extends through the housing between an outlet end 26 of the passage shown to the left in FIG. 4 and an inlet end 28 of the passage shown to the right in FIG. 4. The outlet end 26 of the passage is dimensioned to receive the nozzle head 30 of the sprayer shown in FIG. 1. The discharge passage terminates at the inlet end 28 at an end wall 32 that extends through the middle of the discharge passage and around the periphery of the discharge passage. A valve seat 34 is recessed into the middle of the end wall and faces the inlet end 28 of the discharge passage. The end wall 32 is formed stationary within the pump chamber section 20 and defines a pair of semicircular exit openings 36, 38 on opposite sides of the end wall.

The exit openings 36 are portions of two liquid passages 40, 42 that extend through the pump chamber section between the pair of exit openings 36, 38 to two separate sets of check valve abutments 44, 46. The check valve abutments 44, 46 are positioned in two further sections 48, 50 of the separate liquid passages. The check valve abutments 44, 46 limit the movement of ball valve elements within these two additional sections 48, 50 of the liquid passages as will be explained. The two liquid passage sections 48, 50 extend downward from the check valve abutments as shown in FIGS. 4 and 5 to port openings 52, 54 in the passages that communicate the passages with pairs of pump chambers 56, 58 also formed in the pump chamber section 20. Each of the pump chambers 56, 58 has a cylindrical configuration dimensioned to receive a pump piston, yet to be described, for reciprocating movement therein.

It can be seen that the construction of the pump chamber section 20 described thus far provides two separate liquid passageways for flow of separate liquid components from the two pump chambers 56, 58 through the port openings 52, 54 and the liquid passage sections 48, 50 bypassing the check valve abutments 44, 46 and flowing through the liquid passage sections 40, 42 to the two exit openings 36, 38. On passing through the two exit openings 36, 38 in a discharge passage end wall 32, the two liquid components pumped from the two pump chambers 56, 58 are mixed together for the first time in the inlet end 28 of the discharge passage 24.

The pump chamber section 20 is also provided with a cylindrical section 60 below the two pump chambers 56, 58 that is dimensioned to receive the vent chamber section 22 therein. The cylindrical section 60 of the pump chamber section has an opening 62 in its forward wall that provides access for a pair of vent pistons extending into the vent chambers of the vent chamber section yet to be described.

In FIG. 1, the nozzle head 30 is shown assembled into the outlet end 26 of the discharge passage 24. The nozzle head 30 has a tubular section 64 that is inserted into the discharge passage outlet end 26 securing the nozzle head to the pump chamber section 20 of the sprayer housing. The tubular section 64 terminates at its left end as shown in FIG. 1 in an orifice wall 66 having a nozzle orifice 68 extending therethrough.

Partially contained within the tubular section 64 of the nozzle head is a fluid spinner assembly 70. The fluid assembly 70 has a fluid spinner at its left end abutting against the orifice wall 66 and a one-way valve 72 at its right end. The one-way valve 72 is formed as a circular diaphragm valve having a projection 74 at its center that seats within the valve seat 34 formed in the end wall 32. The perimeter of the one-way valve 72 seats against the annular portion of the end wall 32. The construction of the one-way valve 72 permits a flow of fluid through the two exit openings 36, 38 in the end wall 32 into the inlet end 28 of a discharge passage 24, but prevents the reverse flow of fluid from the discharge passage inlet end 28 into the two exit openings 36, 38. Although a diaphragm type valve is shown employed as the one-way valve 72, it should be appreciated by those skilled in the art that other types of one-way valve constructions may be employed in place of the diaphragm valve.

A trigger 76 is mounted to the pump chamber housing section 20 for pivoting movement of the trigger relative to the trigger sprayer as is conventional. A push rod assembly 78 is connected to the trigger 76 and extends toward the pair of pump chambers 56, 58 from the trigger. The push rod assembly includes a pair of projecting rods that connect the assembly to a pair of pistons 80, 82 (See FIG. 3). The pair of pistons 80, 82 are mounted in the pair of pump chambers 56, 58 for reciprocating movement of the pistons within the chambers in response to pivoting movement of the trigger 76 on the trigger sprayer. On manipulation of the trigger 76 to the right as viewed in FIG. 1, both pistons 80, 82 will be caused to move to the right in their respective pump chambers 56, 58 reducing the interior volumes of the chambers and forcing any air in the chambers out through the respective port openings 52, 54 when priming the pump, and forcing the two separate liquids out of the pump chambers 56, 58 through the respective port openings 52, 54 after the pump chambers have been primed with the two separate liquids. The push rod assembly 78 also comprises a pair of separate vent piston rods 84 (only one of which is visible in the drawings) that extend to a pair of vent pistons 86 (only one of which is visible in the drawings). On manipulation of the trigger 76 on the pump chamber housing section 20, the pair of vent pistons 86 are also caused to reciprocate within their respective vent chambers yet to be described. Thus, the push rod assembly 78 provides an operative connection between the trigger 76 and the pair of pump pistons 82 and the pair of vent pistons 86. On manipulation of the trigger 76, the pair of pump pistons 82 and pair of vent pistons 86 are caused to reciprocate simultaneously in their respective chambers due to the operative connection with the trigger provided by the push rod assembly 78.

The vent chamber housing 22 has a cylindrical base 88 dimensioned to fit tight within the cylindrical section 60 of the pump chamber housing section 20 as shown in FIG. 1. The vent chamber section 22 also includes a pair of vent chambers 90, 92 positioned side by side at the top of the cylindrical base 88. Each of the vent chambers 90, 92 has a front opening that is accessible through the front opening 62 of the pump chamber housing section 20. As seen in FIG. 1, with the vent chamber housing section 22 assembled into the pump chamber section 20, the pair of vent pistons 86 and their respective vent piston rods 84 extend through the pump chamber housing section front opening 62 into the front openings of the two vent chambers 90, 92, positioning each of the vent pistons 86 in one of the two vent chambers. The two vent chambers 90, 92 also comprise their respective vent ports 94, 96 that communicate the vent chambers with the separate interior volumes to which the trigger sprayer 10 is attached in use. With the vent pistons 86 in their at rest positions relative to the vent chambers 90, 92 shown in FIG. 1, venting communication from the two separate container volumes and the exterior environment of the trigger sprayer through the respective vent ports 94, 96 is blocked by the vent pistons. When the trigger 76 is manipulated to cause the vent pistons to move to the right as shown in FIG. 1 in their respective vent chambers 90, 92, the vent pistons 86 pass over the respective vent ports 94, 96 and thereby establish venting communication from the two separate container volumes through the vent ports 94, 96 and their associated vent chambers 90, 92 to the exterior environment of the trigger sprayer.

The vent chamber housing section 22 also comprises a pair of separate liquid passage columns 98, 100 that extend upwardly from the cylindrical base 88 of the vent chamber housing section. At the top of each liquid passage column is formed a valve seat 102. A ball valve 104 rests on the valve seat 102 thereby providing a check valve at the top of each liquid passage column. Movement of the ball valve 104 off the valve seat 102 is limited by the check valve abutments 44, 46 formed at the top of the pair of liquid passage sections 48, 50 in the pump chamber housing section 20. It should be noted that a portion of the exterior circumference of each liquid passage column 98, 100 is slightly smaller than the interior circumference of the liquid passage sections 48, 50 in the pump chamber housing section 20 into which the liquid passage columns extend. This difference in the exterior dimensions of the liquid passage columns 98, 100 of the vent chamber section 22 and the interior dimensions of the liquid passage sections 48, 50 of the pump chamber section 20 enable the two separate liquids to flow past the pair of check valves in each of the liquid passage sections 48, 50 and to the pair of port openings 52, 54 of the respective pump chambers 56, 58 in the pump chamber housing section 20. As the two liquid passage columns 98, 100 of the vent chamber section 22 extend downwardly from the valve seats 102 they increase in diameter to an exterior diameter dimension that fits snug within the interiors of the liquid passage sections 48, 50 of the pump chamber housing 20, thereby providing a sealed connection between the exterior surfaces of the vent chamber liquid passage columns 98, 100 and the interior surfaces of the pump chamber liquid passage sections 48, 50. At the bottom of each of the liquid passage columns 98, 100, is a connecting neck 106, 108. The connecting necks 106, 108 are positioned side by side within the cylindrical base 88 of the vent chamber section and can best be seen in FIGS. 2 and 3.

Inserted into the cylindrical base 88 of the vent chamber housing section 22, is a dip tube adapter 114. The dip tube adapter interconnects the trigger sprayer 10 with a container having two separate container volumes containing two separate fluid components providing communication between the two separate container volumes and the two separate vent chambers 90, 92 and the two separate liquid passage columns 98, 100.

The dip tube adapter 114 has a cylindrical side wall 124 dimensioned to fit snug within the interior of the vent chamber housing cylindrical base 88. An annular flange 126 is provided at the bottom of the side wall. The flange projects beneath the cylindrical base of the vent chamber housing and over the top of the container neck when the trigger sprayer is connected to the container. Beneath the flange 126 is an annular gasket 128 that provides a seal between the annular flange 126 and the neck of a container when the trigger sprayer is connected to the container. A circular top wall 130 covers over the top of the adapter cylindrical side wall 124. A partition wall 132 depends downward from the top wall 130 and bisects the interior of the adapter surrounded by the side wall 124. As seen in FIG. 1, the partition 132 extends to the bottom surface of the adapter flange 126 and mates against the top of the container partition 14 in sealed engagement. Together, the gasket 128 and the sealed engagement between the adapter partition 132 and the container partition 14 seal the separate interior volumes 16, 18 of the container from each other and prevent leakage of liquids between these two separate volumes.

Figure 3:
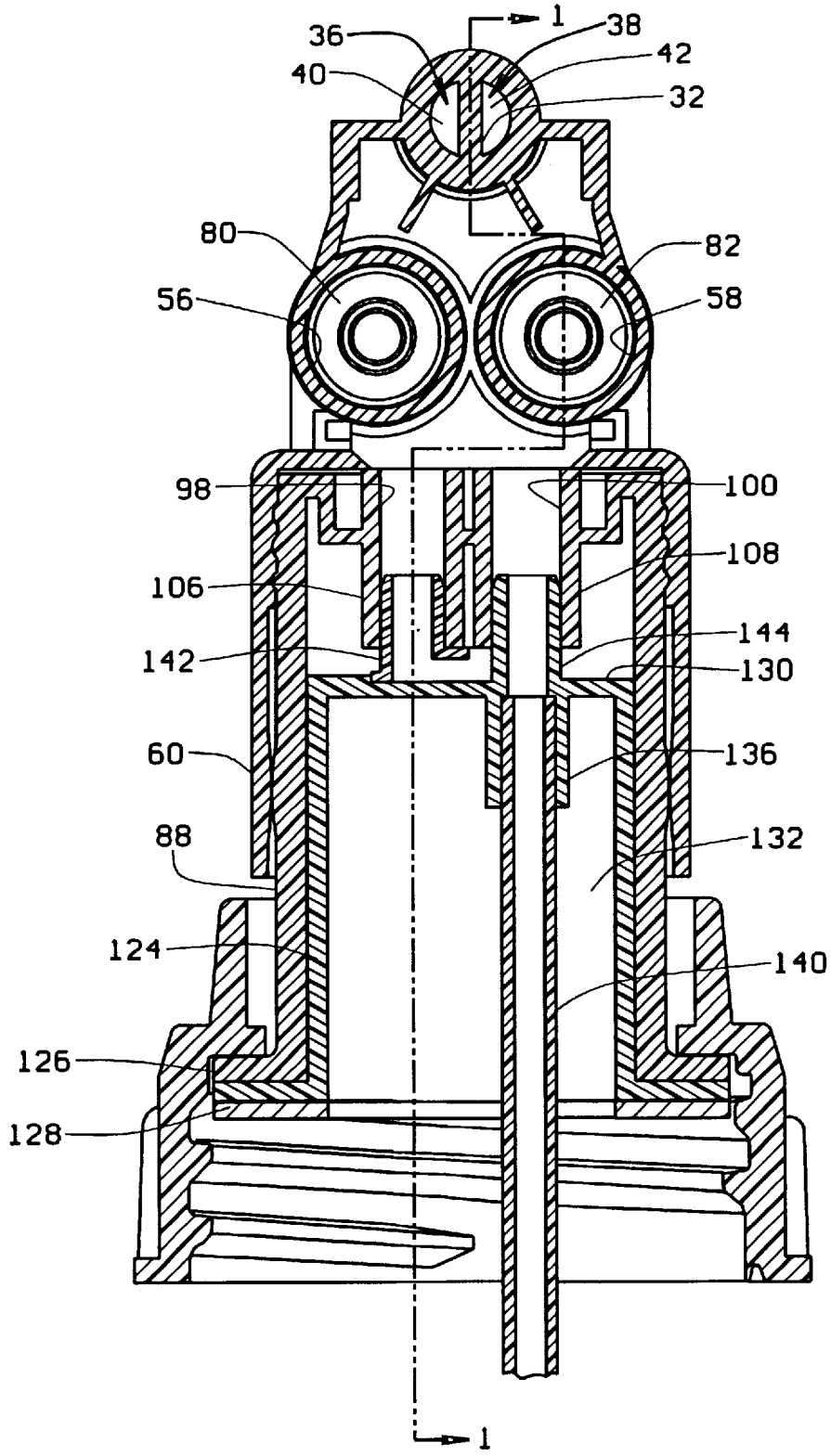
FIG. 3 is a rear elevation view in section of the trigger spray of FIG. 1 taken along the line 3—3 in FIG. 1.

A pair of dip tube coupling sleeves 134, 136 depend downwardly from the adapter top wall 130. Each of the dip tube sleeves are positioned on an opposite side of the adapter partition 132. The interiors of the dip tube sleeves 134, 136 are dimensioned to receive respective dip tubes 138, 140 therein. As seen in FIG. 1, each of the dip tubes 138, 140 received in the respective dip tube sleeves 134, 136 depend downward into the two respective separate interior volumes 16, 18 of the container 12. The dip tube sleeves 134, 136 have openings through the adapter top wall 130 and communicate with the respective liquid passage columns 98, 100 through respective intermediate fluid conducting conduits 142, 144. As seen in FIGS. 1 and 3, the dip tube 140 extends upwardly through the interior of the adapter 114 and into the dip tube sleeve 136. Liquid passing through this dip tube 140 also passes through the dip tube sleeve 136 into the intermediate conduit 144 seen in FIG. 3. The intermediate conduit 144 projecting upwardly from the top wall 130 of the adapter communicates with the connecting neck 108 of the liquid passage column 100 of the pump chamber housing section 20. The liquid passage column 100 communicates with the pump chamber 58 through the check valve seat 102 and the chamber port opening 54.

Figure 2:
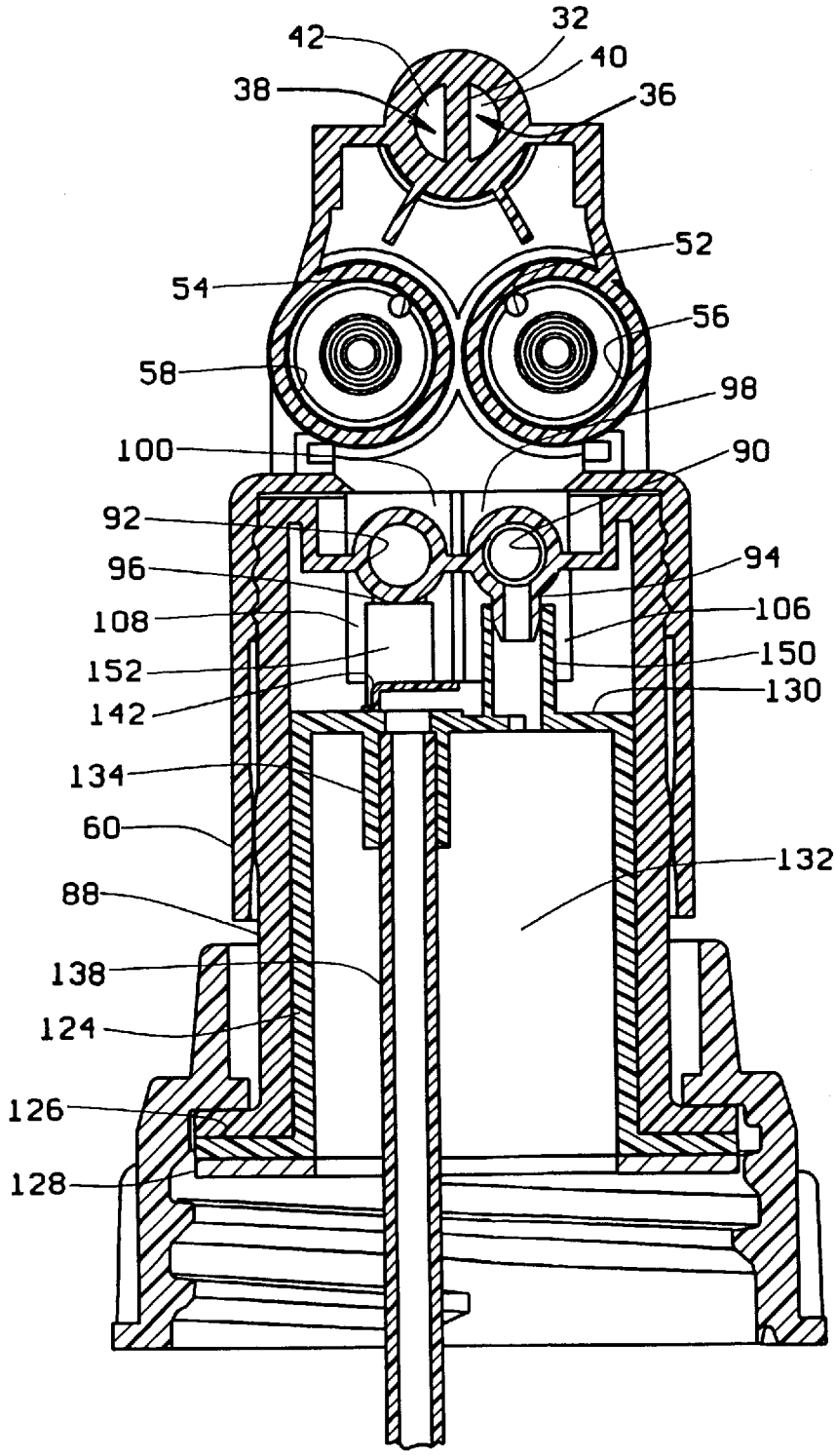
FIG. 2 is a front elevation view in section of the trigger sprayer of FIG. 1 taken along the line 2—2 in FIG. 1.

As seen in FIGS. 1 and 2, the other dip tube 138 extends upwardly through the interior of the adapter 114 and into the dip tube sleeve 134. Liquid passing through this dip tube 138 also passes through the dip tube sleeve 134 into the intermediate conduit 142. The intermediate conduit 142 communicating with the dip tube 138 has an angled configuration best seen in FIG. 1. The intermediate conduit 142 is secured to the adapter top wall 130 in a sealed engagement and channels liquid received from the dip tube 138 through a section of the conduit 142 that extends over the adapter top wall 130 to another section of the conduit that projects from the top wall into the connecting neck 106 of the liquid passage column 98 of the pump chamber housing section 20. This intermediate conduit 142 provides liquid communication from the dip tube 138, through the conduit, through the liquid passage column 98 to the pump chamber 56 through the pump chamber port opening 52. The angled configuration of the intermediate conduit 142 permits the spaced positioning of the two dip tubes 138, 140 in which they depend into the separate interior volumes of the container 12.

Also projecting upwardly from the top wall 130 of the adapter is a pair of vent port conduits 150, 152. The vent port conduit 150 communicates through an opening in the adapter top wall 130 with the separate interior volume 16 of the container when the trigger sprayer is connected to the container 12, and the vent port conduit 152 communicates through an opening in the adapter top wall 130 with the separate interior volume 18 of the container when the trigger sprayer is connected to the container. The vent port conduit 150 also communicates with the vent port 94 of the vent chamber 90. The vent port conduit 152 communicates through the vent port 96 with the vent chamber 92. With the arrangement described, as the vent pistons 86 are reciprocated in their chambers 90, 92 past the respective vent port openings 94, 96, communication between the exterior environment and the container interior volume 16 is established through the vent chamber 90, the vent port opening 94 and the vent port conduit 150. Communication between the exterior environment and the container interior volume 18 is established through the vent chamber 92, the vent port opening 96 and the vent port conduit 152. In this manner, the sealed, separate interior volumes of the container are both vented to the exterior environment of the trigger sprayer.

In drawing liquid from the separate container volumes 16, 18, the trigger 76 is manipulated causing the two pump pistons 80, 82 to reciprocate within their respective pump chambers 56, 58. The reciprocation of the pistons in their chambers draws liquid up through the two dip tubes 138, 140 and through their respective intermediate conduits 142, 144 to their respective liquid passage columns 98, 100. From the liquid passage columns 98, 100, the two separate liquids continue their travel bypassing the valve seats 102 at the top of each column and being drawn into the pump chambers 56, 58 through their respective port openings 52, 54. With the pump chambers filled with the two separate liquids drawn from the separate container volumes, continued reciprocation of the pump pistons in their chambers causes the two separate liquids to be forced out of the port openings 52, 54, through the liquid passage sections 48, 50 outside the liquid passage columns 98, 100 and to the respective liquid passage sections 40, 42 leading to the discharge passage 24. From the liquid passage sections 40, 42, the two separate liquids pass through the exit openings 36, 38 in the end wall 32 of the discharge passage and into the inlet end 28 of the discharge passage where the two separate liquids are mixed for the first time. From the inlet end 28 of the discharge passage, the now mixed two liquids continue through the passage and are dispensed through the nozzle orifice 68 of the sprayer.

With the construction of the trigger sprayer described above, two separate liquid components are kept separate from each other in two separate container volumes and are not mixed with each other until the two separate liquids are drawn from the volumes by the trigger sprayer through a pair of separate pump chambers to the sprayer discharge passage 24 where the two separate components are mixed together for the first time.

While the present invention has been described by reference to a specific embodiment, it should be understood that modifications and variations of the invention may be constructed without departing from the scope of the invention defined in the following claims.

What is claimed is:

1. A trigger sprayer which draws at least two separate liquids from two separate container volumes and mixes the liquids prior to their being dispensed by the sprayer, the sprayer comprising:

a sprayer housing, the housing having a cap for attaching the housing to two separate container volumes containing two separate liquids;

a fluid discharge passage in the housing, the discharge passage having a length with opposite ends with a nozzle orifice for dispensing liquid from the discharge passage at one end and an inlet opening for receiving liquid into the discharge passage at the opposite end;

a pair of separate pump chambers in the housing;

a pair of separate liquid passages in the housing, each passage of the pair extending between one of the pair of pump chambers and the discharge passage inlet, and between one of the pair of pump chambers and one of the two separate container volumes containing two separate liquids when the sprayer housing is attached to the two separate container volumes; and, each of the pair of pump chambers has a piston mounted therein for reciprocating movement of the piston in the pump chamber; and a single trigger is mounted on the sprayer housing for pivoting movement of the trigger relative to the housing, the trigger is operatively connected to the piston mounted in each of the pump chambers to cause reciprocating movement of the pistons in the pump chambers in response to pivoting movement of the trigger on the sprayer housing.

2. The trigger sprayer of claim 1, wherein:

means are provided on the sprayer housing for venting the two separate container volumes to an exterior environment of the sprayer housing.

3. The trigger sprayer of claim 2, wherein:

the means for venting the two separate container volumes includes a pair of separate vent chambers in the sprayer housing, each vent chamber communicates with one of the two separate container volumes and each vent chamber has a vent piston mounted therein for reciprocating movement between a first position blocking venting of the container volume through the vent chamber and a second position opening venting of the container volume through the vent chamber; and a single trigger is mounted on the sprayer housing for pivoting movement of the trigger relative to the housing, the trigger is operatively connected to the vent piston mounted in each of the vent chambers to cause reciprocating movement of the vent piston in response to pivoting movement of the trigger on the housing.

4. The trigger sprayer of claim 1, wherein:

a pair of check valves are contained in the sprayer housing, each check valve of the pair is positioned in one of the pair of liquid passages.

5. The trigger sprayer of claim 1, wherein:

each liquid passage of the pair of separate liquid passages has an exit opening that opens into the inlet opening of the discharge passage.

6. A trigger sprayer which draws at least two separate liquids from two separate container volumes and mixes the liquids prior to their being dispensed by the sprayer, the sprayer comprising:

a sprayer housing, the housing having a cap for attaching the housing to two separate container volumes containing two separate liquids;

a fluid discharge passage in the housing, the discharge passage having a length with opposite ends with a nozzle orifice for dispensing liquid from the discharge passage at one end and an inlet opening for receiving liquid into the discharge passage at the opposite end;

a pair of separate pump chambers in the housing;

a pair of separate liquid passages in the housing, each passage of the pair extending between one of the pair of pump chambers and the discharge passage inlet, and between one of the pair of pump chambers and one of the two separate container volumes containing two separate liquids when the sprayer housing is attached to the two separate container volumes;

each liquid passage of the pair of separate liquid passages has an exit opening that opens into the inlet opening of the discharge passage; and, a one-way valve is contained in the discharge passage at the inlet opening, the one-way valve seats over the pair of exit openings of the pair of liquid passages and permits liquid flow from the pair of exit openings into the inlet opening while preventing liquid flow from the inlet opening into the pair of exit openings.

7. A trigger sprayer which draws at least two separate liquids from two separate container volumes and mixes the liquids prior to their being dispensed by the sprayer, the sprayer comprising:

a sprayer housing, the housing having a cap for attaching the housing to two separate container volumes containing two separate liquids;

a fluid discharge passage in the housing, the discharge passage having a length with opposite ends with a nozzle orifice for dispensing liquid from the discharge passage at one end and an inlet opening for receiving liquid into the discharge passage at the opposite end, the inlet opening being positioned adjacent an end wall of the discharge passage that is stationary within the sprayer housing;

a pair of separate liquid passages in the housing, each passage of the pair extending between the discharge passage inlet opening and one of the two separate container volumes containing two separate liquids when the sprayer housing is attached to the two separate container volumes;

a pair of exit openings in the discharge passage end wall opening into the discharge passage at the inlet opening of the discharge passage, each liquid passage of the pair of separate liquid passages communicating with the discharge passage through one of the pair of exit openings in the discharge passage end wall; and at least one pump in the sprayer housing communicating with at least one of the liquid passages.

8. The trigger sprayer of claim 7, wherein:

the housing cap attaches the sprayer housing to a single container having two separate container volumes containing two separate liquids.

9. The trigger sprayer of claim 7, wherein:

a one-way valve is contained in the discharge passage and controls liquid flow through the pair of exit openings in the discharge passage end wall, the one-way valve is positioned in the discharge passage to permit liquid flow through the pair of exit openings and into the inlet opening of the discharge passage while preventing liquid flow from the inlet opening of the discharge passage into the pair of exit openings.

10. The trigger sprayer of claim 7, wherein:

the pump communicates with the discharge passage through at least one of the liquid passages and through at least one of the exit openings in the discharge passage end wall.

11. The trigger sprayer of claim 10, wherein:

the pump includes a pump chamber having a piston mounted therein for reciprocating movement of the piston in the pump chamber.

12. The trigger sprayer of claim 7, wherein:

a pair of separate pumps are contained in the sprayer housing, each pump of the pair of pumps communicates with one of the pair of liquid passages.

13. The trigger sprayer of claim 7, wherein:

the sprayer housing contains means for venting the two separate container volumes to an exterior environment of the container volumes.

14. The trigger sprayer of claim 7, wherein:

a single trigger is mounted on the sprayer housing for pivoting movement of the trigger relative to the housing;

a pair of separate pumps are contained in the sprayer housing, each pump of the pair includes a pump chamber with a piston mounted in the pump chamber for reciprocating movement of the piston therein, each piston of the pair of separate pumps is operatively connected to the trigger for causing reciprocating movement of the pair of pistons in response to pivoting movement of the trigger.

15. The trigger sprayer of claim 7, wherein:

a pair of separate check valves are contained in the sprayer housing, each check valve of the pair is positioned in one of the pair of liquid passages.

16. A trigger sprayer which draws at least two separate liquids from two separate container volumes and mixes the liquids prior to their being dispensed by the sprayer, the sprayer comprising:

a sprayer housing, the housing having a cap for attaching the housing to two separate container volumes containing two separate liquids;

a fluid discharge passage in the housing, the discharge passage having a length with a nozzle orifice for dispensing liquid from the discharge passage at one end and an inlet opening for receiving liquid into the discharge passage at an opposite end of its length;

a pair of separate liquid passages in the housing, each passage of the pair extending between the discharge passage inlet opening and one of the two separate container volumes containing two separate liquids when the sprayer housing is attached to the two separate container volumes;

at least one pump chamber in the sprayer housing communicating with at least one of the pair of liquid passages, a piston mounted in the pump chamber for reciprocating movement therein;

a trigger mounted on the sprayer housing for pivoting movement of the trigger relative to the housing, the trigger being operatively connected to the pump piston for causing reciprocating movement of the pump piston in the pump chamber in response to pivoting movement of the trigger;

a pair of separate vent chambers in the housing, each vent chamber of the pair communicating with one of the two separate container volumes containing two separate liquids when the sprayer housing is attached to the two separate container volumes; and each vent chamber having a vent piston mounted in the vent chamber for reciprocating movement therein between a first position of the vent piston in the vent chamber blocking venting of the container volume through the vent chamber to an exterior environment of the container volume, and a second position of the vent piston in the vent chamber opening venting of the container volume through the vent chamber to the exterior environment, the vent pistons being operatively connected to the trigger for causing reciprocating movement of the vent pistons in the vent chambers in response to pivoting movement of the trigger on the housing.

17. The trigger sprayer of claim 16, wherein:

the housing cap attaches the sprayer housing to a single container having two separate container volumes containing two separate liquids.

18. The trigger sprayer of claim 16, wherein:

a pair of separate pump chambers are contained in the sprayer housing, each pump chamber communicates with one of the pair of separate liquid passages, and each pump chamber has a piston mounted therein which is operatively connected to the trigger for causing reciprocating movements of the pistons in the pump chambers in response to pivoting movement of the trigger on the sprayer housing.

19. The trigger sprayer of claim 16, wherein:

a pair of check valves are contained in the sprayer housing, each check valve of the pair is positioned in one of the pair of liquid passages.

20. The trigger sprayer of claim 16, wherein:

each liquid passage of the pair of separate liquid passages has an exit opening that opens into the inlet opening of the discharge passage.

21. The trigger sprayer of claim 20, wherein:

a one-way valve is contained in the discharge passage at the inlet opening, the one-way valve seats over the pair of exit openings of the pair of liquid passages and permits liquid flow from the pair of exit openings into the inlet opening while preventing liquid flow from the inlet opening into the pair of exit openings.

22. A trigger sprayer which draws at least two separate liquids from two separate container volumes and mixes the liquids prior to their being dispensed by the sprayer, the sprayer comprising:

a sprayer housing adapted to be communicated with two separate container volumes containing two separate liquids;

a fluid discharge passage in the housing, the discharge passage having a length with opposite ends with a nozzle orifice for dispensing liquid from the discharge passage communicating with one end and an inlet opening for receiving liquid into the discharge passage at the opposite end;

a pair of separate pump chambers in the housing;

a pair of separate liquid passages in the housing, each liquid passage of the pair extending between one of the pair of the pump chambers and the discharge passage inlet, and between one of the pair of pump chambers and one of the two separate container volumes containing two separate liquids when the sprayer housing is communicated with the two separate container volumes; and, a dip tube adapter in the sprayer housing, the dip tube adapter having a pair of dip tube coupling sleeves, each dip tube coupling sleeve communicating with one of the pair of separate liquid passages.

23. The trigger sprayer of claim 22, further comprising:

a pair of dip tubes communicating with the dip tube coupling sleeves.

24. The trigger sprayer of claim 22, further comprising:

the dip tube adaptor having a side wall that extends around the pair of dip tube coupling sleeves.

25. The trigger sprayer of claim 24, further comprising:

the dip tube adaptor having a top wall, the side wall projecting from the top wall, and the dip tube adaptor having at least one vent port conduit that projects from the dip tube adaptor top wall.

26. The trigger sprayer of claim 24, further comprising:

the dip tube adaptor having a top wall, the side wall projecting from the top wall, and a pair of openings through the top wall communicating each of the dip tube coupling sleeves with one of the pair of separate liquid passages.

27. The trigger sprayer of claim 24, further comprising:

the sprayer housing having a cylindrical base chamber; and, the dip tube adapter side wall being fit snug inside the sprayer housing cylindrical base chamber.

28. The trigger sprayer of claim 24, further comprising:

the sprayer housing having a cap for attaching the housing to two separate container volumes containing two separate liquids; and, the dip tube adapter side wall having an annular flange that is positioned to be engaged between the cap and the two separate container volumes when the sprayer housing is attached to the two separate container volumes.

29. The trigger sprayer of claim 28, further comprising:

an annular gasket positioned adjacent the annular flange.

30. A trigger sprayer which draws at least two separate liquids from two separate container volumes and mixes the liquids prior to their being dispensed by the sprayer, the sprayer comprising:

a sprayer housing, the sprayer housing having a cap for attaching the sprayer housing to two separate container volumes containing two separate liquids;

a fluid discharge passage in the sprayer housing, the discharge passage having a length with opposite ends with a nozzle orifice for dispensing liquid from the discharge passage communicating with one end and an inlet opening for receiving liquid into the discharge passage at an opposite end;

a pair of separate pump chambers in the sprayer housing, the pair of pump chambers being positioned side by side and being spaced above the cap; and, a pair of separate liquid passages in the sprayer housing, each passage of the pair extending between one of the pair of pump chambers and the discharge passage inlet, and between one of the pair of pump chambers and one of the two separate container volumes containing two separate liquids when the sprayer housing is attached to the two separate container volumes.

31. The trigger sprayer of claim 30, further comprising:

the pair of pump chambers each having cylindrical lengths that are aligned side by side.

32. The trigger sprayer of claim 31, further comprising:

the length of the fluid discharge passage being aligned with the lengths of the pair of pump chambers.

33. The trigger sprayer of claim 30, further comprising:

a flexible valve in the fluid discharge passage, the flexible valve seating over the inlet opening of the fluid discharge passage.

34. The trigger sprayer of claim 33, further comprising:

a liquid spinner in the fluid discharge passage adjacent the nozzle orifice; and, the flexible valve being attached to the liquid spinner.

35. The trigger sprayer of claim 33, further comprising:

the flexible valve being positioned in the fluid discharge passage to control the flow of liquid through the pair of separate liquid passages into the fluid discharge passage, and to prevent the reverse flow of liquid from the fluid discharge passage into the pair of separate liquid passages.

* * * * *